US007257869B2

(12) United States Patent
Lin

(10) Patent No.: US 7,257,869 B2
(45) Date of Patent: Aug. 21, 2007

(54) ZIPPER HEAD ASSEMBLY STRUCTURE

(75) Inventor: Yu-Pau Lin, Tao Yuan Hsien (TW)

(73) Assignee: Chung Chwan Enterprise Co., Ltd., Tao Yuan Hsien (TW)

( * ) Notice: Subject to any disclaimer, the term of this patent is extended or adjusted under 35 U.S.C. 154(b) by 3 days.

(21) Appl. No.: 11/332,339

(22) Filed: Jan. 17, 2006

(65) Prior Publication Data

US 2007/0163092 A1 Jul. 19, 2007

(51) Int. Cl.
*A44B 19/30* (2006.01)

(52) U.S. Cl. ..... 24/424; 24/429; 24/421

(58) Field of Classification Search ..... 24/415, 24/418, 420, 421, 423, 424, 429
See application file for complete search history.

(56) References Cited

U.S. PATENT DOCUMENTS 5,664,300 A * 9/1997 Mizuno ..... 24/424
5,729,874 A * 3/1998 Mizuno ..... 24/429
5,809,622 A * 9/1998 Yaguramaki ..... 24/421
6,993,810 B2 * 2/2006 Hamada ..... 24/424

* cited by examiner

*Primary Examiner*—Robert J. Sandy
(74) *Attorney, Agent, or Firm*—Rosenberg, Klein & Lee

(57) ABSTRACT

A zipper head assembly structure includes a fastening slider, a pulling piece, a horse-like hook, an elastic piece and a cap. The top of the fastening slider has a first fixing base and a second fixing base at two ends thereof, respectively. One end of the elastic piece is fixedly connected on the first fixing base of the fastening slider. The elastic piece abuts against the top portion of the horse-like hook. The cap covers the first and second fixing bases of the fastening slider, the end portion of the pulling piece, the horse-like hook and the elastic piece. The zipper head assembly structure of the present invention reduces efficiently the material cost, simplifies the manufacturing procedure much, and reduces the manufacturing cost. Further, the elastic piece is fixed on the fastening slider more firmly, so the elastic piece and the horse-like hook can abut to each other sufficiently.

6 Claims, 5 Drawing Sheets

ZIPPER HEAD ASSEMBLY STRUCTURE

BACKGROUND OF THE INVENTION

1. Field of the Invention

The present invention relates to a zipper head assembly structure, and in particular to a zipper head assembly structure capable of fixing an elastic piece to a fastening slider.

2. Description of Prior Art

With reference to FIGS. 1 and 2, a conventional zipper head assembly structure is shown. The conventional zipper head assembly structure comprises a fastening slider 1, a pulling piece 2, a horse-like hook 3 and a cap 4. The above components of the conventional zipper head assembly structure are assembled in the following procedure. One end portion 22 of the pulling piece 2 is positioned into a recessed space 13 of the fastening slider 1. The pulling piece 2 is pushed toward one end of the fastening slider 1, so that a first fixing base 11 or a second fixing base 12 of the fastening slider 1 can be put around a hole 21 of the pulling piece 2. Then, the horse-like hook 3 is fixed to the first fixing base 11 and the second fixing base 12 of the fastening slider 1. The head portion 31 of the horse-like hook 3 is positioned in a groove 111 of the first fixing base 11, while the tail portion 32 of the horse-like hook 3 is positioned to abut against the bottom of the groove 121 of the second fixing base 12. The abdominal portion 33 of the horse-like hook 3 is supported on the end portion 22 of the pulling piece 2. The stop portion 34 of the horse-like hook 3 extends into a sliding groove 14 of the fastening slider 1 via a horse-like hook hole 15 between the first fixing base 11 and the second fixing base 12. Finally, the cap 4 is used to cover on the first fixing base 11 and the second fixing base 12 of the fastening slider 1. An elastic piece 41 is inserted into the interior of the cap 4 for abutting on the horse-like hook 3.

However, in the above assembling procedure, the elastic piece 41 should be firstly fixed in the cap 4. In order to insert the elastic piece 41 into the cap 4, the area of the elastic piece 41 should be made larger to mate with the interior of the cap 4. Since the elastic piece 41 is made of expensive material, the material cost is increased. Further, in the existing manufacturing procedure, the elastic piece 41 is firstly fixed within the cap 4 in one machine, and then the cap 4 provided with the elastic piece 41 is processed and mounted to the fastening slider 1 in another machine. Therefore, such manufacturing procedure becomes very troublesome, increasing the additional manufacturing cost. Further, since the elastic piece 41 inserted into the cap 4 is positioned slightly far from the horse-like hook 3, the elastic piece should be bent to project downward to abut against the horse-like hook 3. As a result, such bending step makes the manufacturing procedure more troublesome.

Further, since the elastic piece 41 is fixed within the cap 4 with four contacting points, such fixing is not stable. If the elastic piece 41 is subjected to an improper force, the projecting portion of the elastic piece 41 may be become flatter, causing weaker abutment between the elastic piece 41 and the horse-like hook 3.

Therefore, in view of the above drawbacks, the inventor proposes the present invention to overcome the above problems based on his deliberate researches and related principles.

SUMMARY OF THE INVENTION

The object of the present invention is to provide a zipper head assembly structure, which can efficiently reduce the material cost, make manufacturing procedure much simpler and thus reduce the manufacturing cost. Further, the elastic piece can be more stably fixed on the fastening slider, and the elastic piece and the horse-like hook can be sufficiently abutted to each other.

In order to achieve the above object, the present invention provides a zipper head assembly structure, which comprises a fastening slider, a pulling piece, a horse-like hook, an elastic piece and a cap. Both ends of the top of the fastening slider are provided with a first fixing base and a second fixing base, respectively. The first fixing base is provided with a horse-like hook hole. One end of the pulling piece is provided with a hole and an end portion. The end portion is provided on the side identical to that of the hole and at the distal edge of the elastic piece. The end portion is positioned between the first fixing base and the second fixing base. One end of the horse-like hook is a head portion positioned on the second fixing base, while the other end of the horse-like hook is a tail portion abutting against the first fixing base. An abdominal portion is provided between the head portion and the tail portion, and supported on the end portion of the pulling piece. A stop portion extends from the tail portion. The stop portion extends into the fastening slider via the horse-like hook hole of the fastening slider. The elastic piece is adapted to abut against the top of the horse-like hook. One end of the horse-like hook is fixedly connected to the first fixing base of the fastening slider. The cap is adapted to cover on the first and second fixing bases of the fastening slider.

The characteristics and the technical contents of the present invention will be further understood in view of the detailed description and accompanying drawings. However, it should be noted that the drawings are illustrative but not used to limit the scope of the present invention.

DETAILED DESCRIPTION OF THE INVENTION

Figure 1:
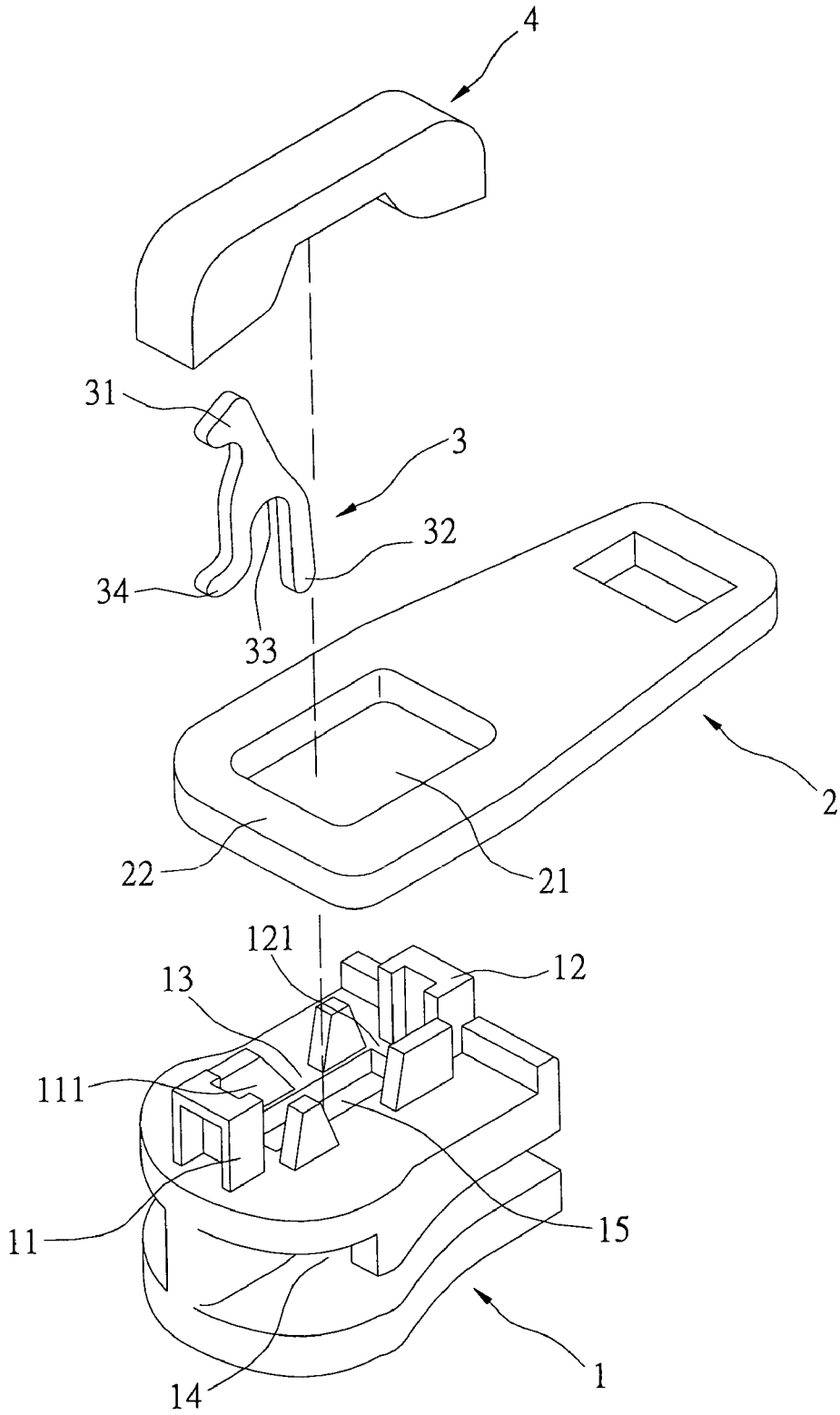
FIG. 1 PRIOR ART
FIG. 1 is an exploded perspective view of a conventional zipper head.
Figure 2:
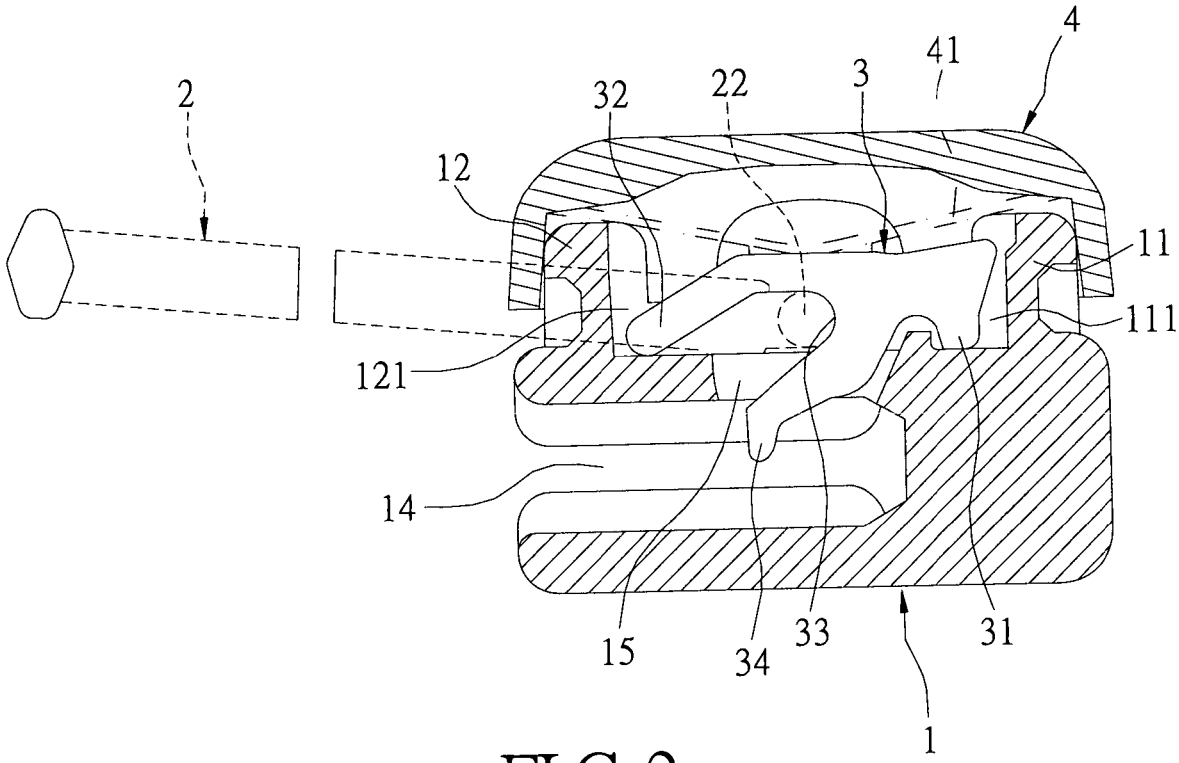
FIG. 2 PRIOR ART
FIG. 2 is a cross-sectional plan view of the conventional zipper head.
Figure 3:
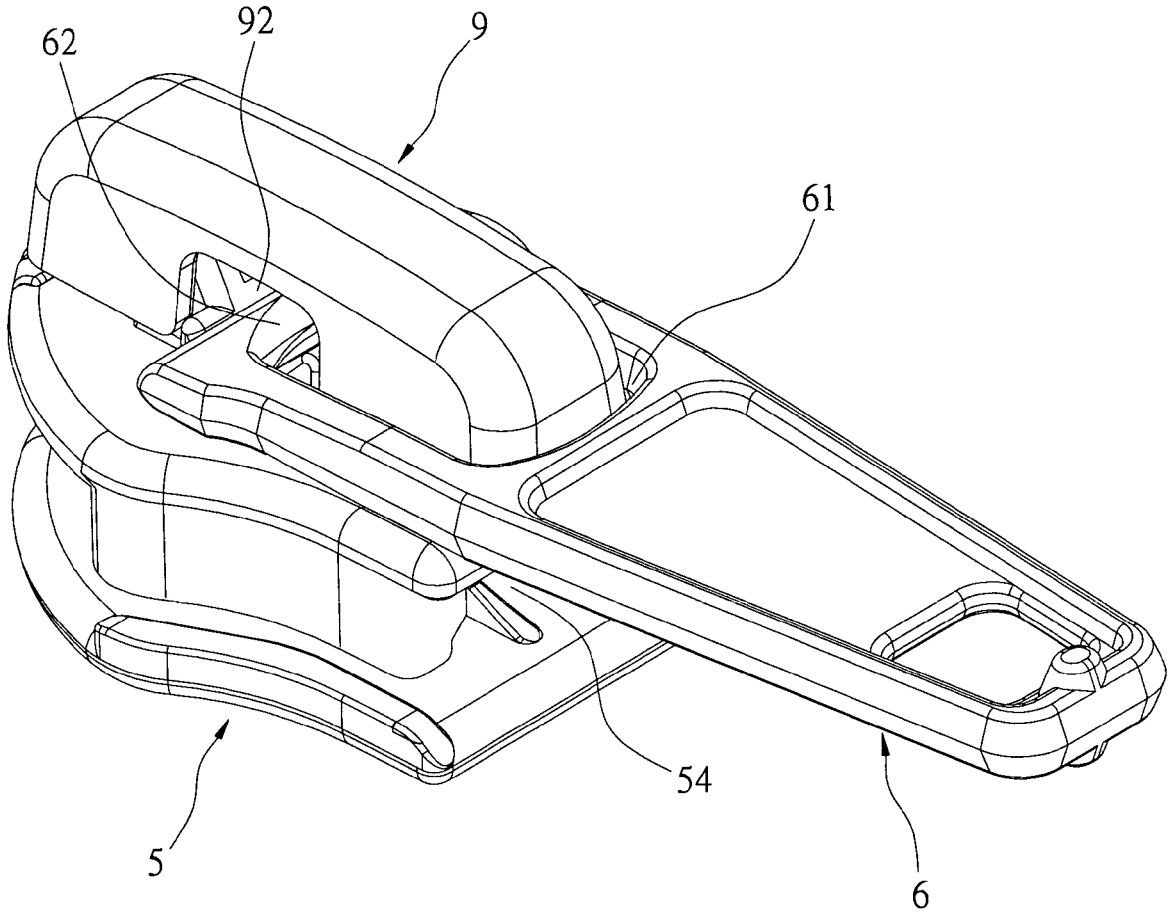
FIG. 3 is a perspective view of the present invention.
Figure 4:
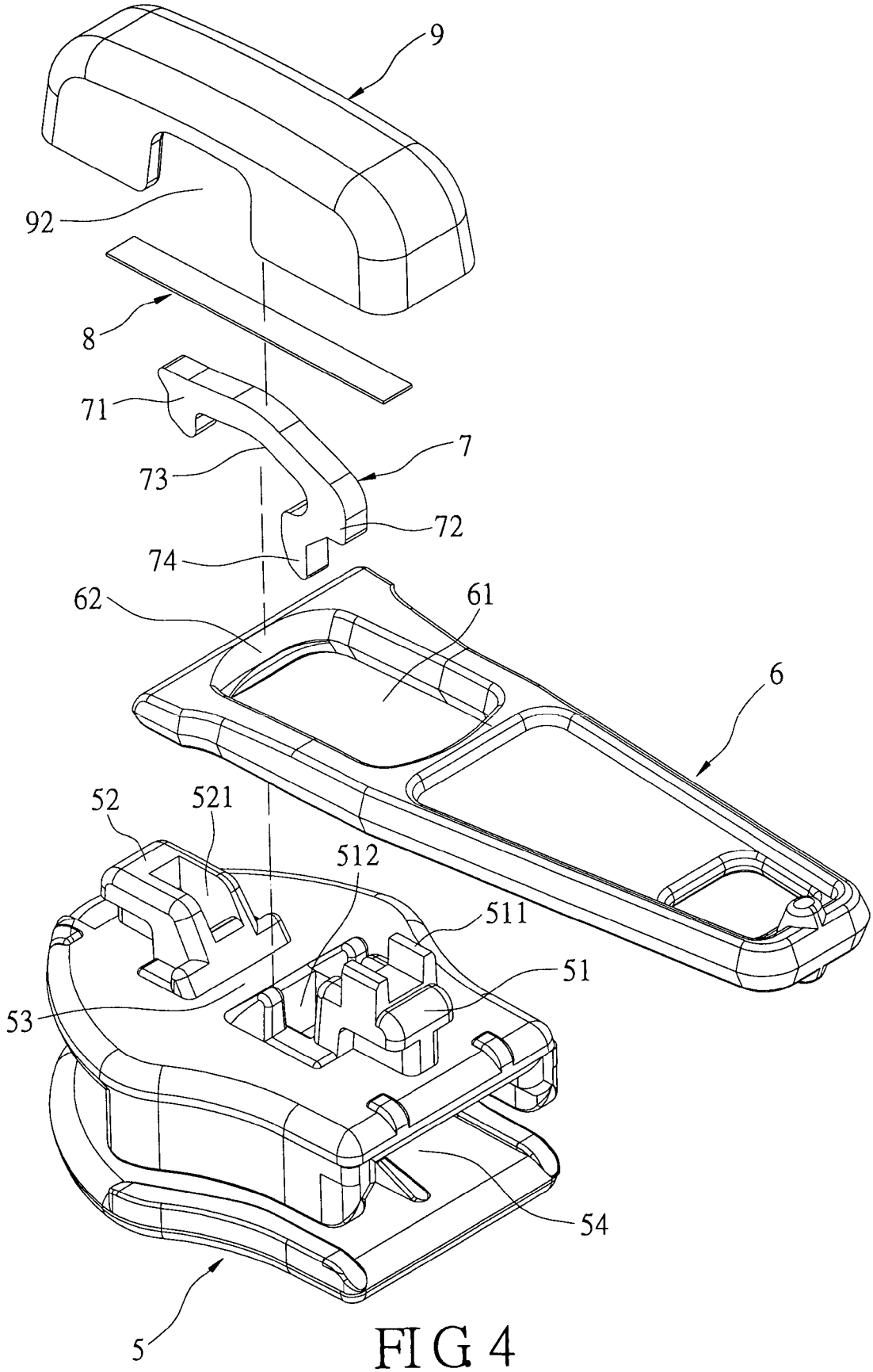
FIG. 4 is an exploded perspective view of the present invention.
Figure 5:
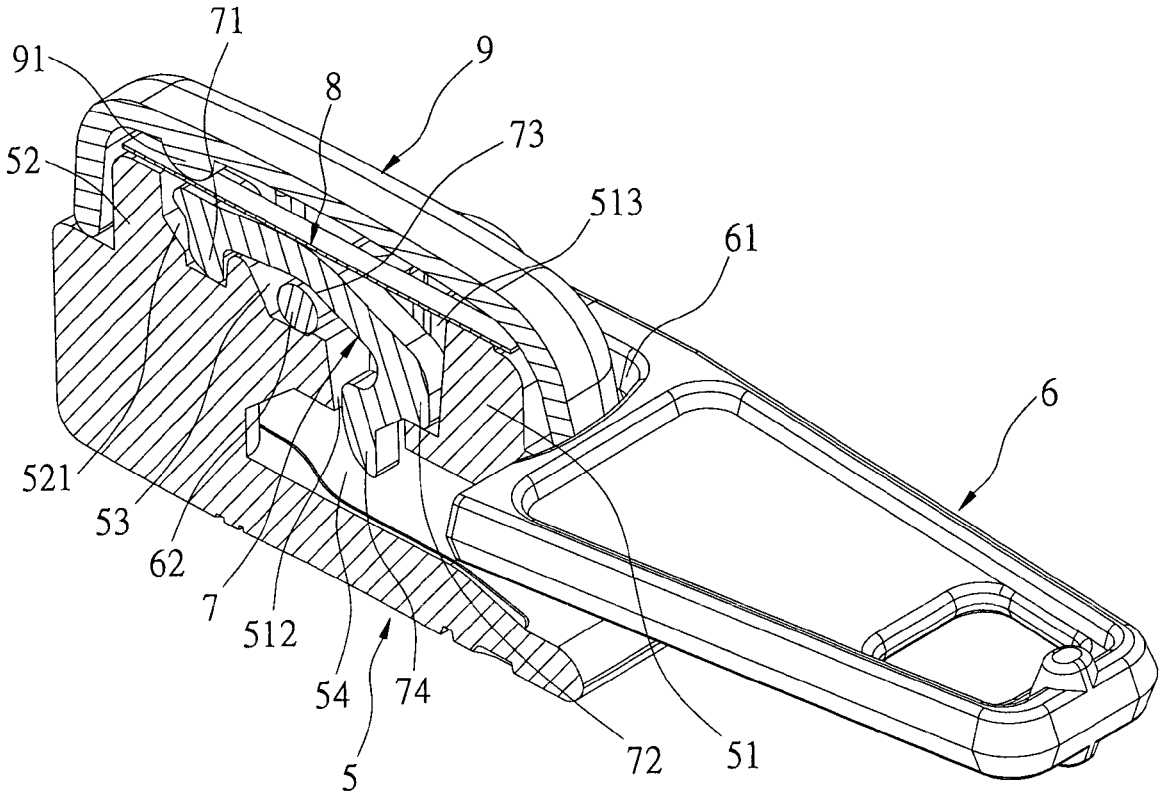
FIG. 5 is a cross-sectional perspective view of the present invention.

With reference to FIGS. 3 to 5, the present invention provides a zipper head assembly structure comprising a fastening slider 5, a pulling piece 6, a horse-like hook 7, an elastic piece 8 and a cap 9. Both ends of the top of the fastening slider 5 are provided with a first fixing base 51 and a second fixing base 52, respectively. A recessed space 53 is formed between the first fixing base 51 and the second fixing base 52. Each of the first fixing base 51 and the second fixing base 52 is provided with a groove 513, 521 on the facing sides, respectively. The first fixing base 51 is provided with a horse-like hook hole 512. On end of the pulling piece 6 is provided with a hole 61. An end portion 62 is provided on the side identical to that of the hole 61 and at the distal edge of the elastic piece 8. The end portion 62 is provided in the recessed space 53 between the first fixing base 51 and the second fixing base 52.

One end of the horse-like hook 7 is a head portion 71 provided within the groove 521 of the second fixing base 52. The other end of the horse-like hook 7 is a tail portion 72 abutting against the bottom of the groove 513 of the first fixing base 51. A concave abdominal portion 73 is provided between the head portion 71 and the tail portion 72. The abdominal portion 73 is supported on the end portion 62 of the pulling piece 6. A stop portion 74 is obliquely extended from the tail portion 72 toward the abdominal portion 73. The stop portion 74 extends into the fastening slider 5 via the horse-like hook hole 512 of the fastening slider 5. The interior of the fastening slider 5 is provided with a sliding groove 54 adapted to penetrate both ends of the fastening slider 5 and communicate with the horse-like hook hole 512 of the fastening slider 5. The stop portion 74 of the horse-like hook 7 extends into the sliding groove 54 via the horse-like hook hole 512 of the fastening slider 5.

The elastic piece 8 is adapted to abut against the top of the horse-like hook 7. One end of the elastic piece 8 is fixedly connected on the first fixing base 51 of the fastening slider 5. The first fixing base 51 is provided with an elastic-piece fixing portion 511. One end of the elastic piece 8 is positioned on the first fixing base 51, so that the elastic-piece fixing portion 511 is located on both sides of one end of the elastic piece 8 and forced to bend, thereby to fix or rivet (not shown) the end of the elastic piece 8. The other end of the elastic piece 8 is supported on the top of the second fixing base 52 of the fastening slider 5.

The cap 9 is adapted to cover on the first fixing base 51 and the second fixing base 52 of the fastening slider 5, so that the elastic piece 8, the horse-like hook 7 and the first and second fixing bases 51, 52 are covered within the cap 9. The interior of the cap 9 is provided with a projecting portion 91 for abutting against the other unfixed end of the elastic piece 8. Each of the both sidewalls of the cap 9 is provided with a notch 92. The end portion 62 of the pulling piece 6 is adapted to penetrate both notches 92.

According to the above, the elastic piece 8 does not need to be inserted into the cap as that in prior art, but can be fixed or riveted by the elastic-piece fixing portion 511 of the first fixing base 51. As a result, the fixing of the elastic piece of the present invention is more stable than that in prior art. After both sides of one end of the elastic piece 8 are fixed, the other end of the elastic piece can be simply fixed by the pressing action of the projecting portion 91. Further, since the distance between the elastic piece 8 and the horse-like hook 7 is smaller, it is not necessary to bend the elastic piece 8 to project downwardly. The elastic piece itself is adapted to sufficiently abut against the horse-like hook 7, simplifying the manufacturing procedure. Further, the elastic piece is not liable to get deformed due to the improper external force. As a result, the elastic piece 8 and the horse-like hook 7 can be sufficiently abutted to each other.

Further, since the elastic piece 8 does not need to be inserted into the cap 9, the area of the elastic piece 8 can be made small, reducing the material cost. Further, since the manufacturing procedure of the present invention only employs one machine to finish the processing and assembling. The manufacturing procedure becomes much simpler, indirectly reducing the manufacturing cost.

Although the present invention has been described with reference to the foregoing preferred embodiment, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A zipper head assembly structure, comprising:

a fastening slider provided with a first fixing base and a second fixing base respectively disposed at opposing ends of a top thereof, the first fixing base being provided with a hole;

a pulling piece having a hole formed therein and an end portion at one end thereof, the end portion being positioned between the first fixing base and the second fixing base;

a hook having a head portion at one end thereof positioned on the second fixing base, the hook being provided at the other end with a tail portion abutting against the first fixing base, an abdominal portion provided between the head portion and the tail portion and supported on the end portion of the pulling piece, and a stop portion extending from the tail portion and into the fastening slider via the hole of the fastening slider;

an elastic piece having one end fixedly connected with the first fixing base of the fastening slider, the first fixing base having an elastic-piece fixing portion located on two sides of the one end of the elastic piece and being bent to fix the one end of the elastic piece to the first fixing base, the elastic piece abutting against the top of the hook; and a cap overlaying the first fixing base and the second fixing base of the fastening slider, the cap having a protrusion extending from an inner side thereof contacting the elastic piece adjacent the second fixing base.

2. The zipper head assembly structure according to claim 1, wherein a space is formed between the first and second fixing bases of the fastening slider, and the end portion of the pulling piece is positioned in the space of the fastening slider.

3. The zipper head assembly structure according to claim 1, wherein each of the first fixing base and the second fixing base is provided with a groove, the head portion of the hook is positioned in the groove of the second fixing base, and the tailed portion of the hook abuts against the bottom of the groove of the first fixing base.

4. The zipper head assembly structure according to claim 1, wherein the fastening slider is provided with a sliding groove penetrating both ends thereof and communicating with the hole of the fastening slider, and the stop portion of the hook extends into the sliding groove via the hole of the fastening slider.

5. The zipper head assembly structure according to claim 1, wherein the abdominal portion of the hook is formed into a concave.

6. The zipper head assembly structure according to claim 1, wherein the elastic piece, the hook and the first and second fixing bases of the fastening slider are totally covered by the cap, each of both sidewalls of the cap is provided with a notch, and the end portion of the pulling piece penetrating both notches.

* * * * *